US005175909A

United States Patent [19]

Pinto

[11] Patent Number: 5,175,909

[45] Date of Patent: Jan. 5, 1993

[54] SUCTION DEVICE

[75] Inventor: Akiva Pinto, Duesseldorf-Wittlaer, Fed. Rep. of Germany

[73] Assignee: Hergeth Hollingsworth GmbH, Duelman, Fed. Rep. of Germany

[21] Appl. No.: 738,382

[22] Filed: Jul. 31, 1991

[30] Foreign Application Priority Data

Feb. 3, 1989 [DE] Fed. Rep. of Germany ..... 3903239

[51] Int. Cl.[5] ..... D01G 7/00

[52] U.S. Cl. ..... 19/80 R

[58] Field of Search ..... 19/80 R, 80 A, 81, 97.5

[56] References Cited

U.S. PATENT DOCUMENTS 4,595,149 6/1986 Hergeth ..... 19/80 R 4,903,374 2/1990 Hösel ..... 19/80 R

FOREIGN PATENT DOCUMENTS 2187216 9/1987 United Kingdom ..... 19/80 R

*Primary Examiner*—Werner H. Schroeder

*Assistant Examiner*—Michael A. Neas

*Attorney, Agent, or Firm*—Bailey & Hardaway

[57] ABSTRACT

A suction device for a bale opener is provided for sucking off fiber flocks having a suction hood (1) being arranged above the opening means of the bale opener, extending over the whole working width and being connected with a suction channel (6) for removal of the sucked fibers, which suction hood (1) has a suction opening opposite the bale surface and consists of two opposite side walls (4, 5) as well as a rear hood-limiting wall (3) and an upper hood-limiting wall (2) which are at least partially curved. The invention provides that the highest point or uppermost portion (13) of the upper hood-limiting wall (2) is arranged in the central area of the working width and that both hood limiting walls (2, 3) of the suction hood (1) have a continuous curve.

4 Claims, 3 Drawing Sheets

SUCTION DEVICE

BACKGROUND OF THE INVENTION

This invention is directed to a suction device for a bale opener, for sucking off fiber flocks, having a suction hood being arranged above the opening means of the bale opener, extending over the whole bale-reducing width and being connected with a suction channel for removal of the sucked fibers, which suction hood has a suction opening facing the bale surface and consists of two opposite side walls and a rear hood-limiting wall delimiting the suction hood on the side of the opening means facing the suction channel and an upper hood-limiting wall delimiting the suction hood toward the top and extending from the suction channel to the side of the opening means facing away from the suction channel.

By such suction devices, the fibers, having been detached from a bale by a bale opener, are sucked off and carried into a transport air stream.

German Laid-open 36 02 898 discloses a suction device arranged at a bale opener for fiber bales, e.g. cotton bales or bales of chemical fibers, in which suction device at least one opening roller is arranged in a housing, the detached fiber flocks being removed in the direction of the longitudinal axis of the opening roller by a suction air stream prevailing within the housing. The suction device, in addition to its two side walls, is provided with two inclined faces for air discharge, rising laterally to these side walls. One of said inclined faces projects in a nose-like manner, into the sucking section and thus, in the lower region of said section, forms an almost symmetrical suction funnel above the bale reducing area.

Such an arrangement of the sucking section above the bale reducing area is disadvantageous in that the sucking section is substantially reduced already slightly above the bale reducing surface whereby an increased suction capacity is required for a certain flow volume. A further disadvantage consists in that the air streams, emerging out of the region below the nose projecting into the sucking section, first flow in a direction almost opposite to the transport air stream and then, at the front end of the nose, have to be deflected by about 140°. This strong deflection of a considerable portion of the overall air stream results to further energy losses, leading also to increased air consumption.

It is the object of the invention to improve a suction device of the above type in such a manner that the specific air and energy consumption is reduced.

According to the invention, this object is solved in that the highest point of the upper hood-limiting wall is arranged in the central area of the bale-reducing width and in that the rear and the upper hood-limiting walls of the suction hood are provided with a continuous curve.

SUMMARY OF THE INVENTION

A suction hood is arranged wherein it is possible, from each position at the suction opening of the suction hood, for the fibers being thrown up by the opening device to be conveyed into the transport air stream while following a slightly curved path. Thus, no losses are caused by deflection of the air streams. The continuous curve of the rear and upper hood-limiting walls provides that the stream profile in the suction hood is not impaired by a sudden narrowed or widened portion of the section, and thus also contributes to the reducing of energy losses. Since the suction hood has its highest point or uppermost portion located substantially over the center of the longitudinal axis of the opening means, it is from this point that at least a considerable portion of the suction air stream starts flowing already in a downward direction to the suction channel, by which downward flow, part of the energy previously required for suction is recovered through release of potential energy.

The opening width of the suction opening can decrease with increasing distance from the suction channel. In this manner, there is achieved an improved distribution of vacuum in the sucking section of the suction opening.

Preferably, the suction hood extends over a plurality of bales. Due to the reduced air and energy consumption, caused by the aerodynamically favorable arrangement of the suction hood, a plurality of bales, arranged next to each other, can be opened at the same time and the fibers can be sucked off over the whole width of the bale opener, a mixing of fibers of different type or origin being already achieved in an advantageous manner. Ventilators of a conventional type as are used in bale openers for a row of bales, are sufficient for generating a flow speed adapted for transport of the fiber flocks.

The upper and rear hood-limiting walls have a radius of curvature the section of which continuously decreases with decreasing distance from the suction channel. In this manner, there is obtained a slowly reduced sucking section providing increased flow speeds. Thus, the sucked fiber flocks are not suddenly accelerated or decelerated and, consequently, no flow losses occur.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
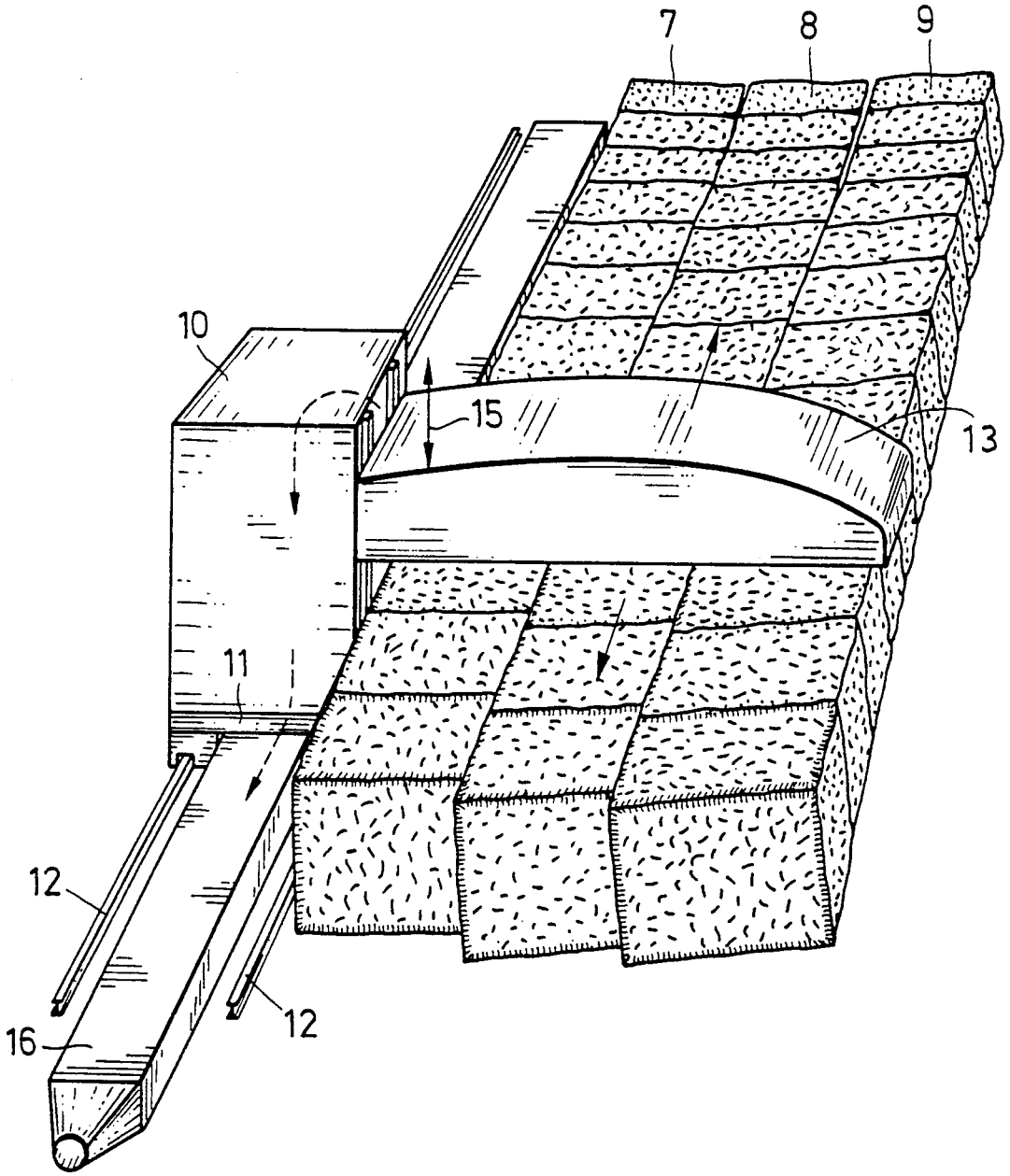
FIG. 1 is a perspective view of a bale opener system being provided with the suction hood of the invention.

FIG. 1 shows a bale opener for three rows of bales 7, 8, 9. The bale opener is provided with a support frame 10 to be moved back and forth along the rows of bales 7, 8, 9 on a carriage 11. Thus, a rail guidance 12 is provided for guiding thereon the wheels (not shown) of carriage 11. The support 10, at one side thereof, is provided with a projecting arm structure 13 which houses a milling device 14 for reducing the fiber bales. The milling device 14 can consist of two milling rollers being driven to rotate about their longitudinal axes. The arm structure 13 carrying the milling device 14 can be moved up and down in height direction according to arrow 15 by an adjustable advance means. Below the support 10 with the carriage 11, there is arranged a channel 16 for receiving and removing the flocks which have been detached from the rows 7, 8, 9 of bales.

Figure 2:
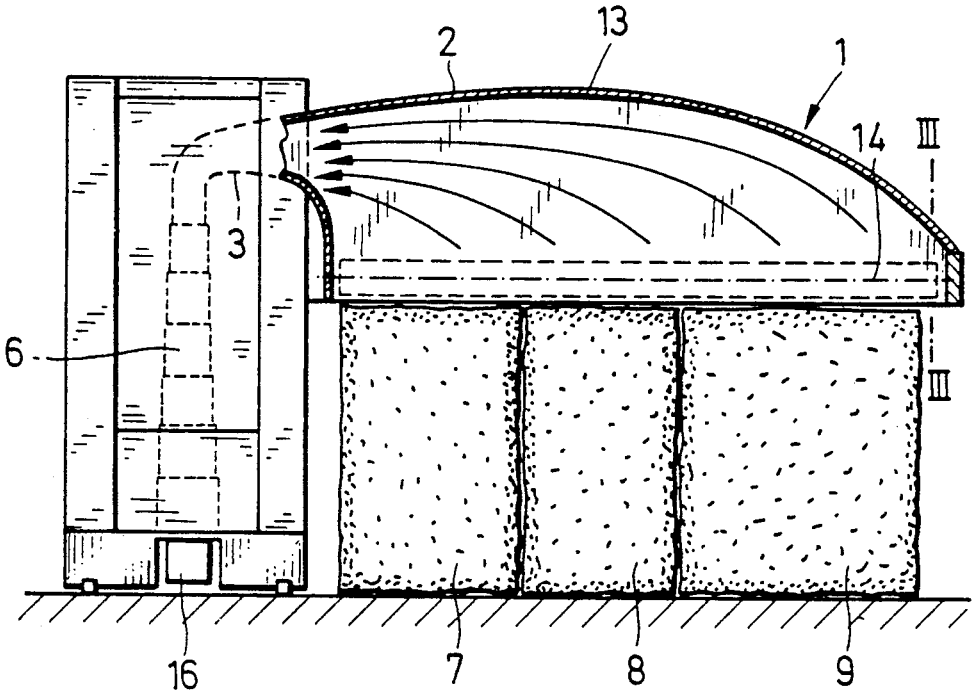
FIG. 2 is a sectional view of the suction hood, indicating the guiding path of the air stream.

The arm structure 13 accommodates the suction hood 1, its sectional profile being substantially evident from FIG. 2. In this suction hood 1, the sucking section is limited by two mutually parallel side walls 4, 5 as well as an upper hood-limiting wall 2 and a rear hood-limiting wall 3, the side walls 4, 5 extending substantially at right angles to the hood-limiting walls 2, 3. The four walls 2 through 5 of the suction hood 1 run into a height-adjustable suction channel 6 which, in turn, enters into channel 16. By the sectional contour of the hood-limiting walls 2 and 3, being continuously curved, respectively, the air suction is aerodynamically optimized over the whole bale reducing width, without flow losses occurring.

The upper hood-limiting wall 2 has its highest point substantially in the center of the longitudinal axis of the milling device 14. It is essential that the air stream is not disturbed by narrowed sectional portions or by being unsteadily guided along the walls. In this manner, optimum effectiveness of the air suction is guaranteed, resulting in low energy consumption or, respectively, a lower specific air consumption per removed fiber quantity.

Figure 3:
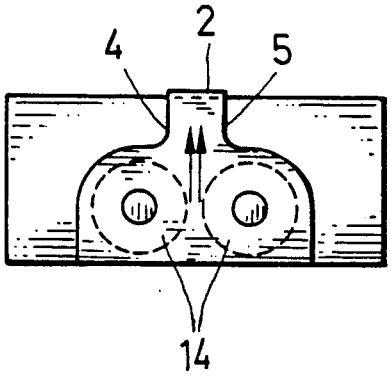
FIG. 3 is a sectional view along the line III—III of FIG. 2.

FIG. 3 is a section through the arm structure 13 at the free end thereof. By the two milling rollers, rotating in opposite senses, the fibers which have been detached from the fiber bales are thrown upwardly into the suction hood 1. In this manner, the fibers, when entering the suction hood, have already been provided with an initial kinetic energy. Then, due to aerodynamical tractive forces, the fibers are conveyed further upward until reaching the highest point of their path, from where they start a downward movement into suction channel 6.

Figure 4:
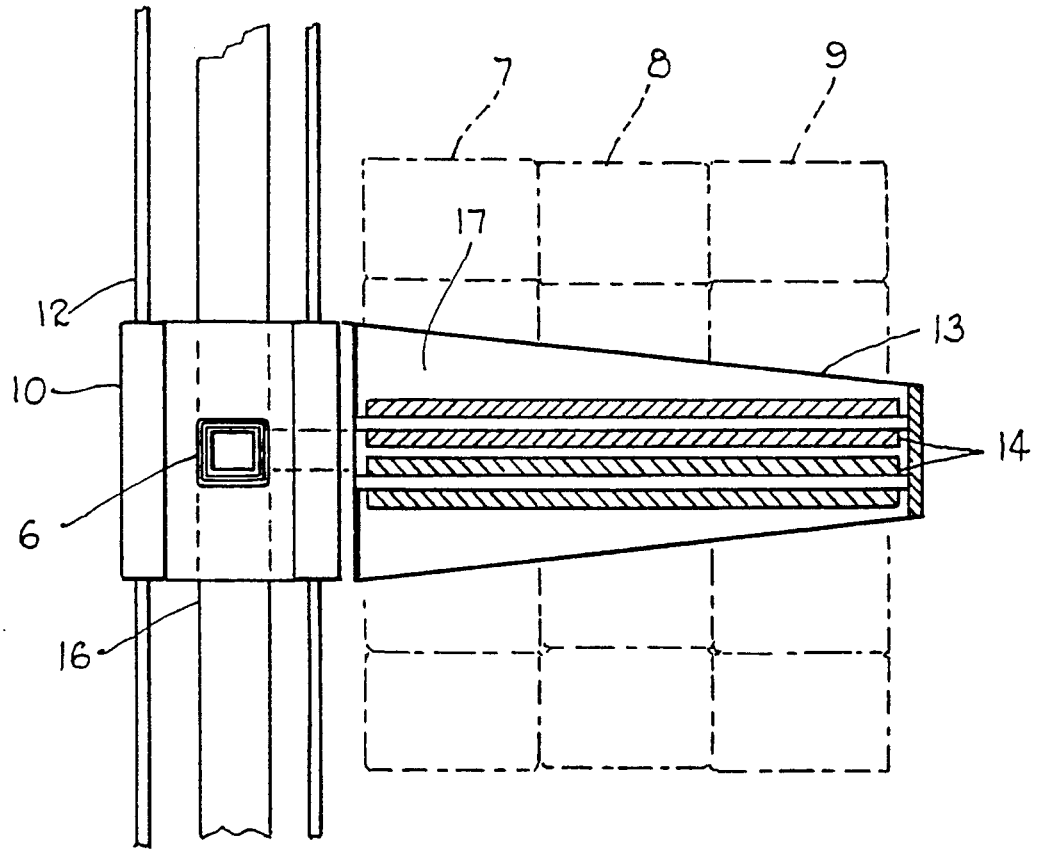
FIG. 4 is a sectional view along the line IV—IV of FIG. 2 and of FIG. 3.

As shown in FIG. 4, the opening width of the suction opening 17 can decrease with increasing distance from the suction channel 6. Such an opening provides an improved distribution of vacuum.

An air stream of 5000 to 6000 $m^3/h$ is sufficient for an air structure 13 of a length up to 3 m.

While a preferred embodiment of the invention has been described using specific terms, such description is for illustrative purposes only, and it is to be understood that changes and variations may be made without departing from the spirit or scope of the following claims.

What is claimed is:

1. A suction device for a bale opener, for sucking off fiber flocks, having a suction hood being arranged above the opening means of the bale opener, extending over the entire working width and being connected with a suction channel for removal of the sucked fibers, which suction hood has a suction opening facing the bale surface and consists of two opposite side walls and a rear hood-limiting wall delimiting the suction hood on the side of the opening means facing the suction channel and an upper hood-limiting wall delimiting the suction hood toward the top and extending from the suction channel to the side of the opening means facing away from the suction channel, the improvement comprising:

an uppermost portion of the upper hood-limiting wall located in a central area of the bale-reducing width; and the rear and said upper hood-limiting walls of the suction hood having curvature.

2. The structure set forth in claim 1 wherein the opening width of the suction opening decreases with increasing distance from the suction channel.

3. The structure set forth in claim 2 wherein the suction hood extends over a plurality of bales, arranged next to each other in a plurality of rows of bales.

4. The structure set forth in claim 1 wherein the rear and the upper hood-limiting walls have a radius of curvature which continuously decreases with decreasing distance from the suction channel.

* * * * *